United States Patent [19]

Pivoteau et al.

[11] 4,435,479

[45] Mar. 6, 1984

[54] PACKAGING FOR FRAGILE, HEAVY AND/OR DEFORMABLE PRODUCTS

[75] Inventors: Jean Pivoteau, Le Viviers Du Lac; Jean-Pierre Durot, Montmelian, both of France

[73] Assignee: Vetrotex Saint-Gobain, France

[21] Appl. No.: 446,259

[22] Filed: Dec. 2, 1982

[30] Foreign Application Priority Data

Dec. 4, 1981 [FR] France ..... 81 22721

[51] Int. Cl.[3] ..... B65D 57/00; G09F 1/06

[52] U.S. Cl. ..... 428/542.8; 428/906

[58] Field of Search ..... 206/446–521; 428/542.8, 11, 12, 542.8, 906

[56] References Cited

U.S. PATENT DOCUMENTS 2,615,564 10/1952 Post ..... 206/446

3,319,866 5/1967 Kitchell ..... 206/521

*Primary Examiner*—Henry F. Epstein

*Attorney, Agent, or Firm*—Pennie & Edmonds

[57] ABSTRACT

A packing for support of a material within an outer package. The packing is formed from a single blank of sheet material to form a reinforced flange spindle.

10 Claims, 3 Drawing Figures

FIG_1
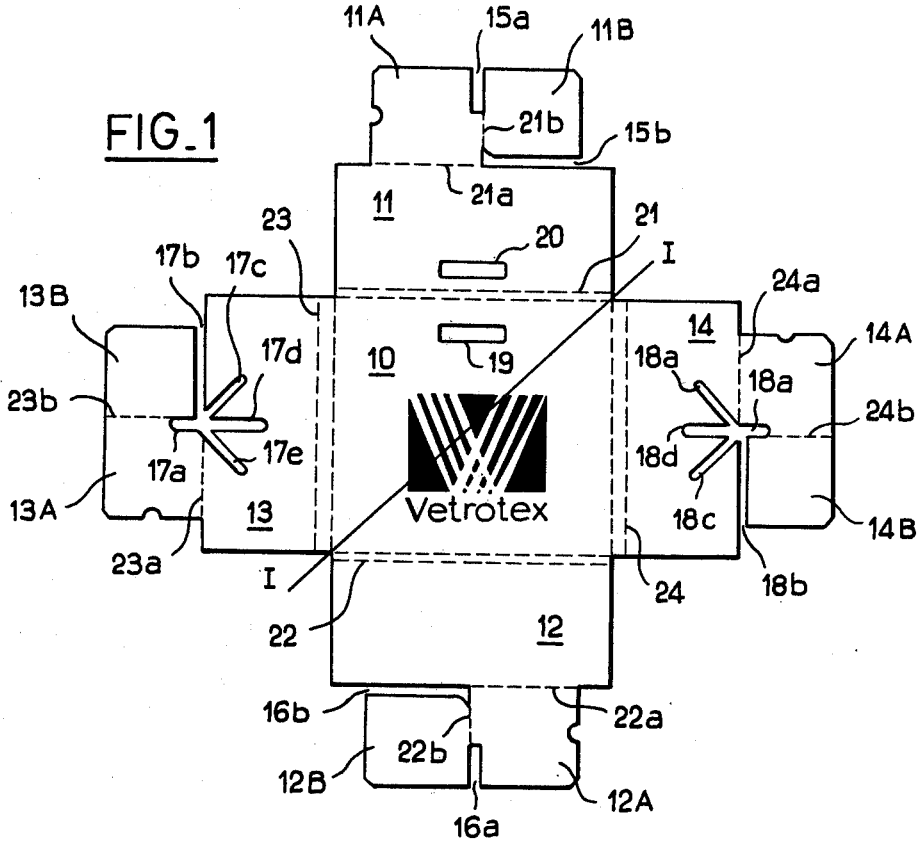
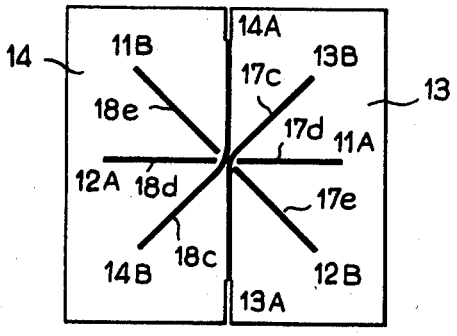
FIG_2
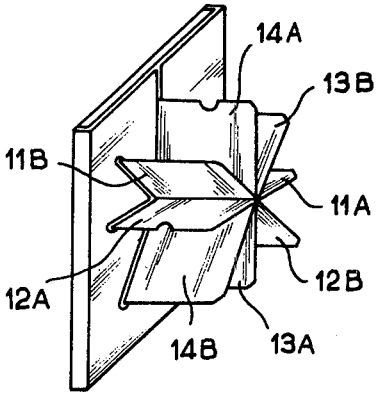
FIG_3

PACKAGING FOR FRAGILE, HEAVY AND/OR DEFORMABLE PRODUCTS

DESCRIPTION

1. Technical Field

The invention relates to a packing or support for a material which may be wound upon itself through several turns to provide a hollow cavity or reeled on a core having a hollow cavity. The packing is folded from a blank to provide a flange and spindle, the latter of which is adapted to extend into the hollow cavity to support the material. The material may be a yarn of glass fiber.

2. Background Art

A packing or support of the type to be described herein which may be used for support of a reel of material for shipping or storing is known. Representative of the prior art are U.S. Pat. Nos. 2,615,564 to J. D. Post and 3,319,866 to T. C. Kitchell.

Referring to the Kitchell patent, there is a disclosure of various problems then experienced in the fixed support for shipment or storage of reeled materials, such as film, yarn, flexible tubing, wire, fabrics and the like, all of which are wound about a hollow support or core. These problems were indicated as primarily relating to movement during shipment of the reeled material within an outer container and resultant damage sustained by the reeled material and/or the outer container.

To the end of overcoming the above problems Kitchell describes a packing or support for maintaining the reeled material in fixed position within the outer container. The packing is formed from a pair of blanks of pliable material, by folding portions of each blank about a score line and connecting the two blanks during the overall process of assembly to form a packing which may, as an integral unit include a flange and spindle. In support of the reeled materials, the spindle of each of two supports are entered into the hollow cavity at opposite ends of the core.

The Post patent provides a disclosure of a packing of a type somewhat similar to that described by Kitchell. Post, however, describes a packing formed from a single blank of pliable material including a pair of tongues struck from the portion of the blank which ultimately serves as a flange, and a tab extending from each of a pair of opposed flaps folded into a position juxtaposed to a surface of the flange. The tongues and tabs are folded to extend from the flange and serve as a spindle.

The Kitchell and Post structures are considered to suffer from various problems and disadvantages.

Referring to Kitchell, it appears that a rather large surface of pliable material is required to support the reeled material if supported on a hollow support or core of large diameter, or else the packing may be limited to use in the support of reeled material of reduced weight. On the other hand, it may be that the packing will have to be limited in use, that is, limited in use to shipping or storing reeled materials wound about a hollow support or core having a small diameter opening.

To this end, unless the surface of the pliable material is increased, all the while maintaining a physical relationship of size of the component parts of the blank, that is, the central zone, side portions and tongues, an increase in size of tongue will result in a decrease in resistance, for example, to buckling offered by the flange in support of the reeled material. Thus, if the tongue extending from the side portions is increased in width (in the direction normal to the longitudinal center line), and this is the only change, it will be required, also, to increase the size of the cruciform shaped opening in the central zone which ultimately receive the tongues of each blank in the process of assembly. If, of course, the dimensional relationships of all component parts is maintained, then the size of the blank will be increased in relation to the increase in the width of the tongues.

Referring to Post, while the packing requires a blank of less size and, in fact, only a single blank in its overall fabrication, it is considered that the packing is limited in utility in substantially the same manner as the support of Kitchell, and suffers the same problems and disadvantages.

SUMMARY OF THE INVENTION

The invention in a packing for support of fragile, heavy, and/or readily deformable material including a longitudinal cavity or pair of cavities into which a spindle of the packing is received is considered not to suffer from the problems and disadvantages of the prior art and, additionally the packing provides advantages over the prior art as will be set out below.

The packing of the invention serves to maintain the material or product, which may be a winding of glass fibers, in a fixed position within an outer package so that the material, during handling, is maintained out of contact with the outer package. In this manner, the packing prevents deformation and degradation of the material.

The packing is formed from a single blank of pliable material including a central zone of rectangular preferably square outline, a flap of rectangular outline extending from the individual sides of the central zone and a tab extending from each flap. Each flap is of an area about one-half the area of the central zone, and each flap is disposed so that its major dimension extends from a side of the central zone. The individual tabs are similarly disposed and each tab which includes a pair of equal size wing regions has a surface area less than that of a flap.

The blank, as described, includes a fold line which may be a double fold line providing a line of demarcation between each flap and the central region having substantially a continuous surface area, and a fold line providing a line of demarcation between each flap and the tab extending from the flap. Further, the blank includes a fold line providing a line of demarcation between each of the two wing regions of which each individual tab is comprised, and a slot is provided to separate alternate wing regions from an adjacent edge of a flap. The several flaps and wing regions are folded about the respective fold lines to create a flange of three-ply thickness and a spindle which exhibits the same resistance in support of material irrespective either of the orientation of the material on the spindle or the packing and material in an outer package.

A pair of packings may be required in the overall support of material and each packing is formed from a single blank of pliable material, such as paperboard or corrugated cardboard provided with unidirectional reinforcement. The manner of folding the blank, particularly the flaps and tabs, about fold lines is such that the wing regions of each tab which form the spindle are solid with the four flaps juxtaposed to the central zone, and the reinforcements of the pliable material are parallel to a diagonal across the central zone.

BRIEF DESCRIPTION OF THE DRAWING

FIG. 1 is a plan view of a blank of material from which a packing including flange and spindle be formed;

FIG. 2 is a plan view of the formed packing; and

FIG. 3 is a perspective view of the formed packing.

BEST MODE FOR CARRYING OUT THE INVENTION

The packing of the invention is fabricated from a blank of pliable sheet material, such as paperboard and corrugated cardboard, to name a few. The blank may be seen perhaps to best advantage in FIG. 1.

The sheet material will have the physical characteristics necessary for carrying out the function of support of reeled material which may be fragile, heavy and/or deformable, and which may be supported on a core or wound in a fashion to provide a hollow cavity within the winding of material. In a preferred embodiment, the packing is used to support a wet roll of glass fiber, wound on a core.

The blank includes a central zone 10 of rectangular, preferably square outline and a plurality of opposed pairs of flaps 11–12 and 13–14. Each flap extends from a marginal edge of the central zone. Each flap further, is of rectangular outline, including a major dimension extending along substantially the full length of an edge of the central zone and a minor dimension which is substantially equal to one-half the major dimension. According to this construction, the whole surface area of the flaps is approximately equal to twice the surface area of the central zone, and the surface area of each flap is approximately equal to one-half the surface area of the central zone. Thus, as discussed below, when the blank is folded in the formation of the packing the central zone which provides the flange of the packing will be of a three-ply thickness.

Additionally, a tab extends from each flap. More particularly, the tabs extend from the edge along the major dimension of the flap opposite the side connecting with the central zone. The tabs may be overall rectangular in outline, disposed in the same disposition as the flap and of an area less than the area of a flap.

As may be seen in FIG. 1, each tab includes a pair of wing portions A and B located along the major dimension of a flap and each wing portion is of substantially equal surface area. With continued reference to FIG. 1, the wing portions of the tab extending from flap 11 are wing portions 11A and 11B; while the wing portions of the tab extending from flap 12 are wing portions 12A and 12B, and so forth. The regions of the wing portions of each tab are delimited at least in part by a fold line and the region of each tab and flap is delimited by a further fold line. The first-mentioned fold lines are fold lines 21*b*, 22*b*, 23*b* and 24*b*, while the second-mentioned fold lines are fold lines 21*a*, 22*a*, 23*a* and 24*a*. The fold line 21*a*, and each other like fold line extends from an edge of the wing portion 11A to a point of merger into a slot 15*b* which separates the wing portion 11B from the adjacent flap 11. Thus, the fold line 22*a* extends from an edge of the wing portion 12A to a point of merger into slot 16*b* which separates the wing portion 12B from the adjacent flap 12, and so forth.

The tabs extending from flaps 11 and 12 are similarly formed. To this end, the tabs include a slot 15*a* and 16*a*, respectively, formed from the outer marginal edge toward the fold lines 21*b* and 22*b*, respectively. These last-mentioned fold lines actually merge into the slot. The tabs 13 and 14 are similarly formed, also. These tabs each include a network of slots extending from the point of merger of fold line 23*a* and slot 17*b*, and fold line 24*a* and slot 18*b*. Each network of slots includes a slot 17*a* (18*a*) extending toward fold line 23*b* (24*b*) which separates the regions of the wing portions A and B, and a series of slots 17*c*, 17*d* and 17*e* (18*c*, 18*d* and 18*e*) which fan out like a star in flap 13 (14). The first numerals relate to flap 13, while the numerals in the parentheses relate to slot components within flap 14 and the tab carried by the flap.

The slots 15*a* and 16*a* extend through a distance of about one-half the height of the tab. The slots 17*a* and 18*a* extend through a distance equal to that of slots 15*a* and 16*a* so as to maintain a maximum connective area between the wing portions. And, the slots 17*c*, 17*d*, 17*e* and 18*c*, 18*d*, 18*e* extend through a distance equal to the length of the wing portion 11B, 12B, 13B, 14B.

A pair of cuts 19, 20, optionally, may be located in the central zone 10 and adjacent flap 11, respectively. The cuts, as illustrated in FIG. 1 extend in a parallel direction and provide a manner of gripping the packing when it is formed.

The blank of a pliable sheet material may be formed into a packing with relative ease. The blank for forming the packing is reinforced along lines parallel to a diagonal line I—I, see FIG. 1. As a consequence, the central zone 10, the flaps 11–14 and the wing portions A and B of each tab will exhibit the same resistance to bending in support of material irrespective either of the orientation of the material on the spindle or the packing and material in an outer package.

A series of double fold lines 21, 22, 23 and 24 delimit the central zone 10 and flaps 11, 12, 13 and 14, respectively. In the formation of the packing, the flaps 11, 12 are folded to a position of surface-to-surface contact with central zone 10 thereby to create a double ply thickness. The tabs are first folded along their fold lines 21*a*, 22*a* so that they extend at 90° from the central zone along the line of juncture of the two flaps. Flaps 13 and 14 and their tabs are folded in a similar manner so that the flaps ultimately create a triple ply thickness at the central zone. During the overall process of folding the tabs the wing portion B of each tab is folded along its respective fold lines 21*b*, 22*b*, . . . 24*b* to a location so that these wing portions extend along the line I—I or along a diagonal perpendicular thereto. In this manner, the wing portions 11B, 12B, 13B and 14B will locate to the slots 18*e*, 17*e*, 17*c* and 18*c*, respectively, of flaps 13 and 14, and the wing portions 11A and 12A will locate to the slots 17*d* and 18*d*, respectively, of the same flaps. Both the wing portions 13A and 14A will extend along the line of juncture of the two flaps 13 and 14. Securement of the components of the blank in the folded position is assured by provision of interaction of slots 17*a* and 18*a* (in the tabs extending from flaps 13, 14) in the slots 15*a*, 16*a*. The star-shaped orientation of wing portions is maintained by the interaction between a wing portion and the slot into which it is located.

The star-shaped orientation of wing portions, comprising eight wings emanating outwardly from an axis, may be seen in FIGS. 2 and 3.

The packing may be used to support a material wound on itself in a manner to provide a central hollow cavity or a material reeled on a core having a hollow cavity. In use, and in support of the material, the wing portions are merely received into the hollow cavity. The orientation of the wing portions, that is, the star-shaped pattern created by the wing portions extending from an axis and spaced angularly from adjacent wing portions by an angle of 45° and the orientation of the unidirectional reinforcement of the pliable material, provides that each wing portion will exhibit a substantially equal resistance to bending. Additionally, the symmetrical relationship of wing portions provides that the material irrespective of positioning of an outer package during handling will be adequately supported.

One use of the packing is in the support of glass yarn in wet condition which is reeled on a core. In use, the packing, also, may provide support for a flexible envelope of plastic received about the yarn for purposes of moisture retention. To this end, the ends of the plastic envelope are folded into the hollow cavity and retained in sealing relation against the inner wall of the core by the spindle. The packing and supported yarn then, is received in the outer package with large joining tabs kown as an American box. These boxes accommodate a single or double yarn roll and handling of the box is facilitated by cut outs which are coextensive with the cuts 19, 20 within the region of the flange.

As should be apparent, the size of the central zone 10, and ultimately the three-ply flange, is such that it is secured immovably within the outer package. Further, the outer layer of the continuous glass winding should remain within the confines of the edges of the flange. The yarn may be wound on a core having an internal diameter of about 160 mm and a length of about 260 mm, and the yarn winding may have a diameter of about 320 mm. According to these dimensions, the overall weight of the unit may be about 30 kg.

The boxes may be stacked on a pallet of conventional type. Three boxes may be received on each level or tier and preferably each tier of boxes will be arranged to cross the boxes of the lower tier. In this manner stability of boxes will be improved. The several tiers of boxes may be secured on the pallet by a stretchable film or a cover received thereover.

Advertising, such as illustrated in FIG. 1 desirably may be applied within the central region.

The invention is not limited to the construction or utilization described above, for other forms and modes of embodiment and use are within the scope of the invention. Thus, the packing of invention may be used for shipping fragile objects having a central cavity, or a pari of cavities on opposite faces. The cavities may be circular, or they may be rectangular, such as square. In this connection, the dimensions of the wing portions forming the spindle may be modified to form, after folding, so that the spindle is suited to the cross section of the cavity or cavities into which it is received.

We claim:

1. An article of manufacture formed from a single blank of sheet material for support of a product such as a length of a yarn reeled in a manner to provide an open cavity, said blank including a central zone providing a substantially continuous surface of rectangular outline, a flap extending from each side of said central zone, each flap being foldable in a first direction about a fold line comprising a line of demarcation between said central zone and a respective flap to form a flange having a make up of three coextensive, superposed sheet material layers, a tab extending from each flap, each tab being foldable in a second, opposite direction about individual second fold lines each comprising a line of demarcation between a flap and a tab, and a slot formed at least within a portion of each tab extending coaxially toward a slot in an opposite tab permitting locking interengagement of said tab to form a spindle extending outwardly of said central zone for receipt in said cavity.

2. The blank of claim 1 wherein said central zone is square.

3. The blank of claim 2 wherein each flap is rectangular and of a size whereby the flaps of opposed pairs of flaps when folded upon said central zone have a line of juncture which bisects said central zone.

4. The blank of claim 2 wherein said flaps are equal in size and each tab extending from a flap includes a pair of equal size regions, third fold lines formed in said tabs coaxially of said slots delimiting the area of each tab region, a second slot extending coaxially of each second fold line thereby to separate one of said regions from said flap whereby when each flap is folded in said first direction upon said central zone to form said flange and the tabs are folded in said second, opposite direction, said tab regions separated from said flaps are folded to form a spindle with eight support tabs.

5. The blank of claim 2 wherein said sheet material is reinforced unidirectionally in a diagonal family of reinforcement whereby each tab forming said spindle exhibits the same resistance to bending when loaded by said product.

6. The blank of claim 1 wherein said central zone and a flap include a cut out region, each coextensive with the other, and superposed when said flap is folded on said central zone.

7. In combination, the article of manufacture of claim 1 and a continuous length of glass yarn reeled on a core, wherein said spindle supports one end of said core and a like article of manufacture supports the other end of said core.

8. The combination of claim 7 including an envelope covering said reeled yarn, the ends of said envelope being folded into said core and held by said spindles in the folded position.

9. The blank of claim 4 wherein said slot includes a first and second pair of slots, said slots of said first pair formed in a first pair of opposite tabs from an outer edge toward a flap, said slots of said second pair formed in the adjacent pair of opposite tabs from a point within a tab to a point within said flap from which the tab extends, and wherein said second slots separate alternate regions of said tabs from said flaps.

10. The blank of claim 9 including third slots, said third slots comprising a family of slots formed in a said flaps supporting said adjacent pair of tabs from a point of intersection of said slots of said second pair and said second slots, said family of slots comprising individual pairs of slots extending equiangularly away from said point of intersection.

* * * * *